United States Patent [19]

Abys et al.

[11] Patent Number: 4,512,963

[45] Date of Patent: Apr. 23, 1985

[54] PALLADIUM COMPOUND SYNTHESIS PROCEDURE

[75] Inventors: Joseph A. Abys, Bridgewater; Yutaka Okinaka, Madison, both of N.J.

[73] Assignee: AT&T Bell Laboratories, Murray Hill, N.J.

[21] Appl. No.: 620,671

[22] Filed: Jun. 14, 1984

Related U.S. Application Data

[63] Continuation of Ser. No. 448,514, Dec. 10, 1982, Pat. No. 4,468,296.

[51] Int. Cl.[3] ..... C25D 3/52

[52] U.S. Cl. ..... 423/387

[58] Field of Search ..... 423/385, 387

[56] References Cited

U.S. PATENT DOCUMENTS 2,452,308 10/1948 Lambros ..... 423/383

4,377,450 3/1983 Okinaka ..... 423/592

FOREIGN PATENT DOCUMENTS 2089374 6/1982 United Kingdom .

OTHER PUBLICATIONS

Patent Application Abys-Trop 1-1 Ser. No. 239,151, filed Feb. 27, 1982.

Canadian Journal of Chemistry, vol. 50, "Hydroxy Complexes of Platinum (II) and Palladium (II)", pp. 3694-3699, (1972).

Encyclopedia of Electrochemistry, C. A. Hampel pp. 448-456, and 726-735, (1964).

*Primary Examiner*—John Doll

*Assistant Examiner*—Wayne A. Langel

*Attorney, Agent, or Firm*—Walter G. Nilsen

[57] ABSTRACT

The invention is a process for electroplating palladium in which at least part of the palladium in the electroplating bath is added as a palladium ammine hydroxide. Both the solid form and solution form of palladium ammine hydroxide are useful in supplying palladium to the palladium electroplating bath. Both solution and crystals are chemically stable and can be stored for long periods of time. Further, use of the palladium ammine hydroxide compounds permit replenishment without accumulation of undesirable ions in the bath and also neutralizes hydrogen ions formed in the plating process.

13 Claims, 2 Drawing Figures

PALLADIUM COMPOUND SYNTHESIS PROCEDURE

This application is a continuation of application Ser. No. 448,514, filed Dec. 10, 1982, now U.S. Pat. No. 4,468,296.

TECHNICAL FIELD

The invention is a palladium plating process. In particular, it concerns a procedure for supplying palladium to the palladium plating bath.

BACKGROUND OF THE INVENTION

Palladium has become of increasing importance in plating because of its use as a substitute for gold in many applications, particularly applications involving electrical and electronic devices. Palladium has ideal properties for use in such applications. For example, palladium has excellent physical and chemical stability, high electrical conductivity, and high thermal conductivity. Many such applications involve electrical contact surfaces such as connector pins, relay or switch contacts, contact surfaces on printed wiring boards, etc. Much of the motivation for using palladium (or palladium alloys) lies in the lower price of palladium as compared to gold and the rapid and often unpredictability in the price of gold.

For many applications involving palladium plating, large amounts of palladium are plated very rapidly and replenishment of palladium in the bath on a more or less continuous basis becomes highly desirable. A typical example is palladium plating of contact pins for electrical connectors where large numbers of pins are electroplated at high plating speeds. Here, frequent replenishment is necessary. It is highly desirable to have a replenishment procedure which is convenient and compatible with a high speed palladium plating procedure and permits long lifetime for the palladium plating bath.

SUMMARY OF THE INVENTION

The invention is a palladium plating process in which at least part of the palladium in the plating bath is supplied as a palladium ammine hydroxide. Both solid and solutions of palladium ammine hydroxide are useful in the practice of the invention. The solid has the empirical formula corresponding to palladium diammine hydroxide ($Pd(NH_3)_2(OH)_2$) but may be in one or more forms corresponding generally to the formula $[Pd(NH_3)_2OH]_n(OH)_n$ where n may vary from 1 to 6. Here, the name palladium diammine hydroxide and empirical formula $Pd(NH_3)_2(OH)_2$ refers to one or more forms of a palladium ammine hydroxide including monomer, dimer and polymeric species generally with the formula $(Pd(NH_3)_2OH)_n(OH)_n$. The solution can be made by dissolving the palladium diammine hydroxide in water or preferably ammonia water to form a soluble palladium ammine hydroxide. The identity of the palladium ammine hydroxide species is discussed below. Often, the palladium compound is added as a concentrated solution (at times on a more or less continuous basis). An embodiment of the invention is a procedure for synthesizing an aqueous solution of the soluble palladium ammine hydroxide and isolating the solid palladium (II) diammine hydroxide. The use of palladium ammine hydroxide compounds (solutions of the soluble palladium (II) ammine hydroxide species and palladium (II) diammine hydroxide) to supply palladium and replenish palladium in palladium plating baths has several advantages. First, anions such as chloride ions do not accumulate in the bath (as occurs if $PdCl_2$ or $Pd(NH_3)_2Cl_2$ is used). Such accumulation of anions often limits the lifetime of the bath and sometimes alters the plating characteristics of the bath during the lifetime of the bath. Also, use of the palladium ammine hydroxide compounds neutralizes hydrogen ions produced at the anode so that alkaline agents (e.g., potassium hydroxide) need not be added to the bath. The use of a palladium ammine hydroxide prevents accumulation of cations (potassium ions in the case of potassium hydroxide) which also limit the usefulness and lifetime of the bath. Also, maintaining a constant palladium concentration with a palladium ammine hydroxide compound insures a constant pH for the plating bath. Use of these replenishment compounds leads to long bath lifetimes and constant plating conditions (plating rate, etc.) throughout the lifetime of the bath.

DETAILED DESCRIPTION

Figure 2:
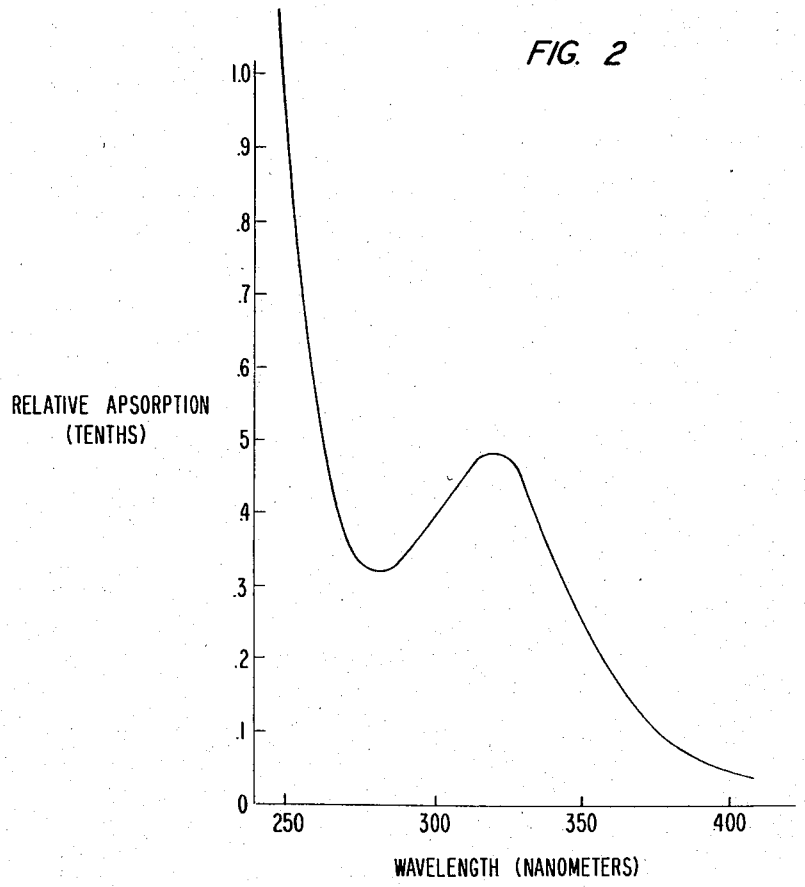
FIG. 2 shows a spectrum of a solution form of a palladium ammine hydroxide compound.

The invention is based on the discovery that a certain class of palladium compounds, generally referred to in this application as palladium ammine hydroxide compounds are particularly useful in supplying palladium to a palladium plating bath.

The exact structural formula for the palladium ammine hydroxide is not known. It is probably different for solid and aqueous solutions and possibly more than one species exists in the solid as well as in aqueous solutions. It is believed that the palladium ammine hydroxide can be represented by the formula $(Pd(NH_3)_x(OH))_n(OH)_n$ with n between 1 and 6 and x equals 2, 3, and 4. It is believed that the solid is in a form where $x=2$ and n equals 1 or 2. There is some possibility that the solid transforms from one form (e.g., $n=1$) to another form (e.g., $n=2$) on standing. Both forms are soluble in ammonia water.

The solution form of palladium ammine hydroxide also has the general formula given above. Probably x varies from 2 to 4 depending perhaps on ammonia concentration in the aqueous solution. Again, the solution form may be monomeric, dimeric, or polymeric (i.e., n may vary from 1 to 6).

The spectra of the complex in solution is shown in FIG. 2. This spectra was obtained by dissolving the solid form of palladium diammine hydroxide in ammonia water. Identical spectra is obtained by dissolving $Pd(NH_3)_2Cl_2$ in ammonia water and converting to a hydroxide by ion exchange in an OH-type anion exchange resin. However, dissolution of $Pd(NH_3)_2Cl_2$ in strong ammonia solution (which presumably forms $Pd(NH_3)_4^{+2}$ ions) yields a different spectra. Possibly, the soluble form is primarily a polymeric species (such as a dimer) similar to the complexes described in "Hydroxy Complexes of Platinum(II) and Palladium(II)" by G. W. Bushnell et al, *Canadian Journal of Chemistry*, Vol. 50, page 3694 (1972).

The palladium ammine hydroxide compound may be used to initially make up the palladium plating bath and/or to replenish the bath during the plating operation.

The palladium ammine hydroxide compound may be added in the form of a solid, concentrated solution of the solution form or more dilute solution where this is convenient. The group of compounds has many advantages as a replenishment agent. First, it can be made easily in pure form from readily available palladium compounds. A large variety of starting materials may be used (generally referred to as palladium diammine compounds) including $Pd(NH_3)_2Cl_2$, $Pd(NH_3)_2Br_2$, $Pd(NH_3)_2I_2$, $Pd(NH_3)_2SO_4$, $Pd(NH_3)_2(NO_3)_2$, etc. Second, it is stable and can be stored over long periods of time without decomposition or deterioration. Third, it is rapidly soluble so that it can be added as a solid to a palladium bath. It was high solubility so that it can be supplied in the form of a highly concentrated solution.

Both the solid and the solution may contain other ingredients besides the ammine compound. Typical substances might be buffers, surface conditioning compounds, conducting salts, etc. For the most part, the solid or solution would consist essentially of the hydroxide compound mentioned above. Included in the invention is a procedure for synthesizing the palladium ammine hydroxide compounds from known, readily available palladium compounds. The procedure is illustrated using $Pd(NH_3)_2Cl_2$ as the starting material. Other palladium compounds can be converted into $Pd(NH_3)_2Cl_2$ by known procedures including those procedures outlined below. In particular, metallic palladium can be converted into $Pd(NH_3)_2Cl_2$ and the synthesis process greatly simplifies the procedure for converting metallic palladium (even metallic palladium in impure form) into a form suitable for use in palladium plating. Although the palladium ammine hydroxide compounds seem most suitable for use in electroplating processes, it may under suitable circumstances be used to supply palladium for electroless baths, sensitizing solutions, etc.

The synthesis for the preparation of the palladium ammine hydroxide compounds may be outlined as follows:

1. Dissolve $Pd(NH_3)_2Cl_2$ in aqueous $NH_4OH$;
2. Treat the resulting solution with an anion exchange resin (OH-form);
3. Freeze-dry this solution to obtain the solid form of palladium ammine hydroxide;
4. Dissolve this compound in aqueous $NH_4OH$ to make a concentrated solution of the solution form.

Either the crystals obtained in step 3 or the concentrated solution obtained in step 4 can be used as the source of palladium in a plating bath. In addition, the solution obtained after step 2 may also be used in the bath.

A more detailed description of each step is set forth below: First, the starting material $Pd(NH_3)_2Cl_2$ is dissolved in a suitable solvent, usually ammonia water. A typical procedure is to make a slurry of $Pd(NH_3)_2Cl_2$ and water, add sufficient concentrated ammonia hydroxide to dissolve the $Pd(NH_3)_2Cl_2$ and remove any particulate matter by filtration. The solution is then diluted with water to obtain a convenient concentration range usually in the range from 100 g/l to 140 g/l in terms of palladium metal.

The solution described above which is probably in the form of $Pd(NH_3)_4{}^{+2}$ ions and $Cl^-$ ions, is exposed to an anion exchange resin (OH form) to remove the chloride ion and replace it with $OH^-$ ion. Either the batch method or column method may be used. Because the solution form is a strong base, a strongly basic type resin is preferred. Excellent results are obtained using a quaternary ammonium type resin such as Amberlite IRA-400 (OH) or IRA-900C (OH). The properties and types of anionic exchange resins have been outlined in a number of references including *Encyclopedia of Electrochemistry* C. A. Hampel, Editor, pp. 448–456 and pp. 726–735, Reinhold Publishing Corporation, New York, 1964.

Although the solution can be used to supply palladium to the bath as is, it is more convenient for most applications to either concentrate the solution or remove the water and isolate the solid. This should be done in such a way as to prevent decomposition of the palladium ammine hydroxide compound. Particularly convenient procedures for removing water is freeze drying and vacuum distillation. Generally, excessive heating should be avoided so that decomposition is minimized. Either of these procedures yields bright yellow crystals. This compound is stable in vacuum or dry atmosphere. It can be stored over long periods of time.

A particularly convenient replenishment procedure is to isolate the solid and then make up a concentrated solution of the solution form by addition of the solid form to aqueous ammonia. Highly concentrated solutions are made generally by use of ammonia solutions. Such solutions are used to replenish palladium baths without excess addition of liquid to the palladium bath.

A variety of bath chemistries may be used in the practice of the invention. Generally, the bath should contain a source of palladium and be sufficiently conducting to permit reasonable electroplating rates (at least $10^{-3}$ mho-cm). Typical are ammonia-based plating solutions often with palladium complexed with ammonia, but other types of palladium plating solutions are also useful. Some typical solutions are given below.

(1)

$Pd(NH_3)_4Cl_2$
$NH_4Cl$
Sufficient ammonia to a pH of 9–10, 9.4 most preferred.

The amount of palladium salt should be at least 10 gm/l in terms of palladium metal. Higher concentrations are often preferred, say at least 20 gm/l or even 100 gm/l.

(2)

$Pd(NH_3)_2(NO_2)_2$: 4 g Pd/l
$NH_4NO_3$ (optional): 90 gm/l
$NaNO_2$ (optional): 11.3 gm/l
Ammonia to pH between 8 and 10, with 9.0 most preferred.

(3) $Pd(NH_3)_4(NO_3)_2$

Salts to stabilize the complex and increase conductivity.

pH=7–10 by the addition of alkaline agent such as ammonia.

(4)

$Pd(NH_3)_2Cl_2$: 10 gm/l to saturation
$NH_4Cl$: 65 to 250 gm/l
pH adjusted by the addition of ammonia to 8.0–9.2 with 8.8 most preferred.

For many applications, a high concentration of the palladium salt is preferred with or without the conducting salts, provided such a bath is stable.

Other palladium complexes are also useful as plating baths in the practice of the invention. The palladium complex $Pd(NH_3)_4Br_2$ is used as the basis for some palladium plating baths. Useful concentrations in terms of palladium metal are from 2 g/l to saturation (about 35 g/l). The pH range is from 9 to 10 with the range from 9 to 9.5 preferred. Other palladium complexes such as the corresponding sulfate, phosphate, tartate, citrate, oxalate and carbonate also may be useful.

The double nitrite salts of palladium are also useful for palladium plating. A typical salt is $K_2Pd(NO_2)_4.2H_2O$. Other similar salts (i.e., potassium replaced by another alkali metal such as sodium, lithium, etc.) may also be used.

Another typical palladium bath contains a palladium solution complexed with ethylenediamine or other complexing agent. Typically, the palladium is added as $PdCl_2$ and sulfate as an alkali-metal sulfate ($Na_2SO_4$). Sufficient complexing agent (i.e., ethylenediamine) is added to dissolve the palladium chloride. Typical concentrations are 28 g/l $PdCl_2$ and 140 g/l $Na_2SO_4$. Increased concentration of palladium compound is desirable up to the saturation concentration of the palladium complex. The pH may vary over the wide limits (i.e., 10–13) but is usually between 11 and 12.

The simple salt $PdCl_2$ is also useful in plating baths in the practice of the invention. Typically, the bath comprises $PdCl_2$, ammonium chloride and a strong acid (generally aqueous HCl) to a pH from 0.1 to 0.5. Typical concentration of $PdCl_2$ is 52 g/l to saturation and 22–38 g/l $NH_4Cl$. Plating temperature to 50 degrees C. is usually used.

Although the source of palladium described above may be used with a great variety of palladium electroplating baths, it is most useful when used with a bath where palladium is complexed with an aliphatic polyamine. Particularly advantageous is an aliphatic polyamine with 3–20 carbon atoms, especially aliphatic diamines with 3–10 carbon atoms. These baths are most preferred because of the excellent plating results obtained and compatibility with the palladium source palladium-1,3-diaminopropanedichloride. More than one aliphatic polyamine may be used in the bath. Typical complexing agents are diaminopropane (particularly 1,3-diaminopropane), diethylenetriamine, 1,4-diaminobutane, 1,6-diaminohexane, etc. Secondary polyamines such as N,N'dimethyl-1,3-propanediamine and tertiary polyamines such as N,N,N',N'tetramethylethylenediamine are also useful provided the total number of carbon atoms does not exceed 20. A limited number of substituents are also useful, such as hydroxy groups (i.e., 2-hydroxy-1,3-diaminopropane) and halogen groups such as chloride and bromide. The complexing agent 1,3-diaminopropane is most preferred because of excellent plating results especially at high plating rates. It is preferred that the aqueous electroplating bath be alkaline (pH greater than 7.0) to avoid corrosion of the surface being plated and sufficiently conductive to allow plating (generally greater than $10^{-3}$ mho-cm). Additional substances may be added to the palladium plating bath to control and adjust pH (such as a buffer), to increase conductivity and to improve the properties of the plated metal. Typical substances used to improve the plated metal are lactones (i.e., phenolphthalein, phenolsulfone-phthalein, etc.), lactams, cyclic sulfate esters, cyclic imides and cyclic oxazolines. Certain polyalkoxylated alkylphenols may also be useful. The process is also useful for plating certain palladium alloys including 10 mole percent palladium, remainder copper, nickel and/or silver.

There are a number of advantages associated with use of organic aliphatic polyamines as complexing agent in palladium electroplating processes. First, the conditions (particularly pH, corrosivity) are much improved so that chemical attack on the surface being plated is much reduced or eliminated. Second, production of hydrogen is eliminated even at high plating rates (even above 200 or even 500 ASF). Third, the quality of plating is much improved even at very high plating rates. The pH of the bath may vary over large limits, but generally alkaline aqueous solution is preferred (typically pH from 7.5 to 13.5) with the range from 9.0 to 12.5 preferred, and 11.0 to 12.5 most preferred. The preference particularly applies when the preferred polyamines are used, namely organic aliphatic diamines with 3 to 10 carbon atoms and most particularly 1,3-diaminopropane. Within the pH range, very rapid plating can be carried out with excellent plating results. Generally, a bath composition which permits rapid plating with more alkaline solution is preferred because of decreased attack on the surface being plated and decreased chances of hydrogen evolution.

The plating process may be carried out with or without a buffer system. A buffer system is often preferred because it maintains constant pH and adds to the conductivity of the bath. Typical buffer systems are the phosphate system, borax, bicarbonate, etc. Preferred is the $HPO_4^{-2}/PO_4^{-3}$ system often made by adding an alkali-metal hydroxide (KOH, NaOH, etc) to an aqueous solution of the hydrogen phosphate ion. Generally, the concentration of buffer varies from about 0.1 molar to 2 molar (about $1.0\pm0.2$ molar preferred) and the mole ratio of hydrogen phosphate to phosphate varies from 5/1 to 1/5 (with equal mole amounts within $\pm50$ percent preferred). These mole ratios often depend on the particular pH desired for the plating bath.

The bath temperature may vary over large limits, typically from the freezing point to the boiling point of the electroplating bath. Often, the preferred plating temperature range depends on bath composition and concentration, plating cell design, pH and plating rate. Preferred temperatures for typical conditions are from room temperature to about 80 degrees C. with 40 to 60 degrees C. most preferred.

Various surfaces may be plated using the disclosed process. Usually, the plating would be carried out on a metal surface or alloy surface, but any conducting surface would appear sufficient. Also, electrolessly plated surfaces may be useful. Typical metal and alloy surfaces are copper, nickel, gold, platinum, palladium (as, for example, a surface electrolessly plated with palladium and then electroplated with palladium in accordance with the invention). Various alloy surfaces may also be used such as copper-nickel-tin alloy, other copper alloys such as beryllium-copper, etc.

The composition of the bath may vary over large limits provided it contains a source of palladium and significant amounts of one or more polyamines of the class set forth above. In general, sufficient polyamine should be present to complex with the palladium. Usually, it is advantageous if excess polyamine is present in the bath solution.

The palladium concentration in the bath typically varies from 0.01 molar to saturation. Preferred concentrations often depend on plating rate, cell geometry, agitation, etc. Typical preferred palladium concentration ranges for high-speed plating (50 to 1000 ASF) are higher than for low-speed plating (up to 50 ASF). Preferred palladium concentration ranges for high-speed plating vary from 0.1 to 1.0 molar. For low-speed plating, the preferred range is from 0.05 to 0.2 molar. Where palladium alloy plating is included, the alloy metal (usually copper, silver or nickel) replaces part of the palladium in the composition of the plating bath. Typically, up to 90 mole percent of palladium may be replaced by alloy metal.

The amount of complexing agent (polyamine) may vary over large limits, typically from 0.5 times (on the basis of moles) the concentration of the palladium species to saturation of the complexing agent. Generally, it is preferred to have excess complexing agent, typically from two times to twelve times the mole concentration of the palladium specie. Most preferred is about six times the sole concentration of palladium. The preferred ranges of complexing agent in terms of palladium species are the same for high-speed and low-speed baths.

The concentration of buffer may vary over large limits. Such concentrations often depend on cell design, plating rates, etc. Typically, the buffer concentration varies from 0.1 molar to saturation with from 0.2 to 2.0 molar preferred.

Figure 1:
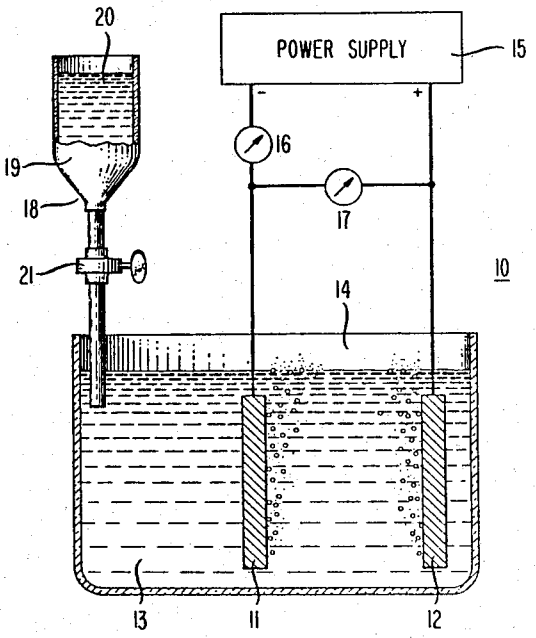
FIG. 1 shows a typical electroplating apparatus including replenishment means useful in the practice of the invention.

FIG. 1 shows apparatus 10 useful in the practice of the invention. The surface to be plated 11 is made of the cathode in the electrolytic process. The anode 12 is conveniently made of platinized titanium or may be made of various other materials such as oxides of platinum group metals, binder metal oxides, etc. Both anode and cathode are partially immersed in the electroplating bath 13 containing source of palladium complex with an organic eliphatic polyamine. A container 14 is used to hold the palladium plating solution and the anode 12 and cathode 11 are electrically connected to source of electrical energy 15. An ammeter 16 and voltmeter 17 are used to monitor current and voltage. The voltage and current are controlled inside the source of electrical energy 15. Palladium is replenished by adding palladium-1,3-diaminopropanedichloride either as a solid or concentrated solution. An apparatus 18 for doing this replenishment is also shown. This apparatus is made up of storage container 19 containing concentration solution 20 and means 21 for controlling the flow of concentrated solution 20 into the palladium electroplating bath 13.

FIG. 2 shows a spectra (the coordinates of absorption vs wavelength) of the solution form in ammonia water. This spectra was obtained by dissolving the solid form of palladium ammine hydroxide in ammonia water. The same spectra is obtained by putting an aqueous ammonia solution of $Pd(NH_3)_2Cl_2$ through an alkaline (OH-form) anion exchange resin. However, dissolution of $Pd(NH_3)_2Cl_2$ in strong ammonia solution does not yield the same spectra. It is speculated that the spectra shown is due primarily to the cation of hydroxy-bridged polymer, probably dimer $[Pd(NH_3)_2(OH)]_2{}^{+2}$, whereas the dissolution of $Pd(NH_3)_2Cl_2$ in ammonia yields $Pd(NH_3)_4{}^{+2}$.

What is claimed is:

1. A process for synthesizing solid form of palladium diammine hydroxide from palladium diammine compound by a procedure comprising the steps of a. dissolving the palladium diammine compound in aqueous ammonium hydroxide to form a first solution, b. treating the first solution with an OH-form of anion exchange resin to form a second solution, c. freeze-drying the second solution to obtain a solid form of palladium ammine hydroxide.

2. The process of claim 1 in which step a is carried out by first making a slurry of palladium diammine compound and water, then adding sufficient concentrated ammonium hydroxide to dissolve the palladium diammine compound, removing any particulate matter by filtration and then diluting with water to a concentration range from 100 to 140 g/l in terms of palladium metal to form a first solution.

3. The process of claim 1 in which step b is carried out with strongly basic type resin.

4. The process of claim 3 in which the resin is a quaternary ammonium type resin.

5. The process of claim 1 in which the palladium diammine compound consists essentially of at least one compound selected from the group consisting of $Pd(NH_3)_2Cl_2$, $Pd(NH_3)_2Br_2$, $Pd(NH_3)_2I_2$, $Pd(NH_3)_2SO_4$, and $Pd(NH_3)_2(NO_3)_2$.

6. The process of claim 5 in which the palladium diammine compound is $Pd(NH_3)_2Cl_2$.

7. A process for synthesizing solution form of palladium ammine hydroxide from palladium diammine compound by a procedure comprising the steps of:

a. dissolving the palladium diammine compound in aqueous ammonium hydroxide to form a first solution, b. treating the first solution with an OH-form of anion exchange resin to form a second solution, said second solution comprising solution form of palladium ammine hydroxide.

8. The process of claim 7 in which the procedure comprises the additional steps of:

a. freeze-drying the second solution to obtain a solid form of palladium ammine hydroxide, b. dissolving the solid form of palladium ammine hydroxide in aqueous ammonium hydroxide to form a concentrated aqueous solution of the solution form of palladium ammine hydroxide.

9. The process of claim 7 in which step a is carried out by first making a slurry of palladium diammine compound and water, then adding sufficient concentrated ammonium hydroxide to dissolve the palladium diammine compound removing any particulate matter by filtration and then diluting with water to a concentration range from 100 to 140 g/l in terms of palladium metal to form a first solution.

10. The process of claim 7 in which step b is carried out with strongly basic type resin.

11. The process of claim 7 in which the resin is a quaternary ammonium type resin.

12. The process of claim 7 in which the palladium diammine compound consists essentially of at least one compound selected from the group consisting of $Pd(NH_3)_2Cl_2$, $Pd(NH_3)_2Br_2$, $Pd(NH_3)_2I_2$, $Pd(NH_3)_2(NO_3)_2$, and $Pd(NH_3)_2SO_4$.

13. The process of claim 12 in which the palladium diammine compound consists essentially of $Pd(NH_3)_2Cl_2$.

* * * * *